US007405635B2

(12) United States Patent
Hashimura et al.

(10) Patent No.: US 7,405,635 B2
(45) Date of Patent: Jul. 29, 2008

(54) MEMS SWITCH

(75) Inventors: Akinori Hashimura, Yokohama (JP); Yasuyuki Naito, Suginami-ku (JP); Kunihiko Nakamura, Sagamihara (JP); Yoshito Nakanishi, Machida (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 346 days.

(21) Appl. No.: 10/572,142

(22) PCT Filed: Dec. 20, 2004

(86) PCT No.: PCT/JP2004/019032

§ 371 (c)(1),
(2), (4) Date: Mar. 14, 2006

(87) PCT Pub. No.: WO2005/062332

PCT Pub. Date: Jul. 7, 2005

(65) Prior Publication Data

US 2007/0092180 A1 Apr. 26, 2007

(30) Foreign Application Priority Data

Dec. 22, 2003 (JP) ..... 2003-424254
Dec. 6, 2004 (JP) ..... 2004-353010

(51) Int. Cl.
*H01P 1/10* (2006.01)

(52) U.S. Cl. ..... 333/105; 333/262

(58) Field of Classification Search ..... 333/105, 333/262, 101; 200/181; 438/52
See application file for complete search history.

(56) References Cited

U.S. PATENT DOCUMENTS 6,218,911 B1 4/2001 Kong et al.

(Continued)

FOREIGN PATENT DOCUMENTS

JP 2003-71798 3/2003

OTHER PUBLICATIONS

Park et al., "Electroplated RF MEMS Capacitive Switches", 2000, pp. 639-644 (Cited on ISR & in Specification, English Text).

*Primary Examiner*—Benny Lee
*Assistant Examiner*—Alan Wong
(74) *Attorney, Agent, or Firm*—Pearne & Gordon LLP

(57) ABSTRACT

It is to provide an MEMS switch easy to manufacture, microscopic, and capable of obtaining a sufficient ON/OFF capacitance change ratio.

An MEMS switch includes a substrate 46, a conductive beam 42 formed on a surface of the substrate, and three-layer structure beams B1 and B2 formed on the surface of the substrate and disposed to be opposed to the conductive beam. The MEMS switch is characterized in that: each of the three-layer structure beams includes a first conductive layer 38, 40, a second conductive layer 30, 32 and a dielectric layer 34, 36 sandwiched between the first conductive layer and the second conductive layer; the first conductive layer is opposed to the conductive beam 42; at least one of the conductive beam 42 and the three-layer structure beams is displaced on a plane parallel to the substrate 46 due to an electrostatic force so that the conductive beam 42 and the first conductive layer 38, 40 can come into contact with each other; and a conductive path is formed between the conductive beam 42 and the second conductive layer 30, 32 when the conductive beam 42 and the first conductive layer are in contact with each other.

21 Claims, 10 Drawing Sheets

U.S. PATENT DOCUMENTS 6,452,124 B1 * 9/2002 York et al. ..... 200/181
6,472,962 B1 * 10/2002 Guo et al. ..... 333/262
6,525,396 B2 * 2/2003 Melendez et al. ..... 257/528
6,891,454 B1 * 5/2005 Naito et al. ..... 335/78
6,982,616 B2 * 1/2006 Nakanishi et al. ..... 335/78

* cited by examiner

MEMS SWITCH

TECHNICAL FIELD

The present invention relates to an MEMS switch, and particularly relates to an MEMS switch formed by use of an MEMS (Micro Electro Mechanical Systems) or NEMS (Nano Electro Mechanical Systems) technique.

BACKGROUND ART

Since electromechanical switches such as MEMS switches are expected to have superior properties as compared with GaAs FET switches or PIN type diode switches, broad researches are being done to apply the MEMS switches to radio communication systems. The MEMS have heretofore come to the fore due to their low loss, good isolation, low power consumption, good linearity, miniaturization, and capability of high integration. However, there has been a problem that the MEMS switches are prevented from being put into practical use, due to their high driving voltage, low operating speed, insufficient reliability, etc.

Generally, a capacitive coupling type MEMS switch is constituted by a fixed electrode, a movable electrode disposed opposite to the fixed electrode, and a dielectric deposited on the movable electrode and/or the fixed electrode. Due to a voltage applied between the movable electrode and the fixed electrode, an electrostatic force is generated to attract the movable electrode to the fixed electrode. Thus, the distance between the electrodes is changed. When the distance between the electrodes is changed, the capacitance, that is, the impedance is changed so that a signal can be turned ON/OFF. Due to the dielectric formed between the movable electrode and the fixed electrode, the coupling is not resistive but capacitive.

In order to obtain a low-loss MEMS switch, it is necessary to reduce the impedance when the MEMS switch is ON. In order to obtain sufficient isolation, it is necessary to increase the capacitance change ratio. This capacitance change ratio can be approximated by the following expression:

$$CON/COFF=(e_0*e*A_{overlap}/d_{diel})/(e_0*e_r*A_{overlap}/d_{air})$$
$$=d_{air}/d_{diel},$$

where $d_{air}$ and $d_{diel}$ designate the thicknesses of the air gap and the dielectric, $e_r$ designates the dielectric constant of the dielectric, and $A_{overlap}$ designates the area of a coupling region of the movable electrode.

One of problems of a capacitive switch is reduction in capacitance change ratio caused by the surface roughness of electrodes. When the surfaces of the electrodes to abut against each other have undulate shapes, a protrusion portion abuts against a protrusion portion so that the distance between the electrodes cannot be reduced sufficiently with respect to the surfaces as a whole. Thus, there has been a problem that the capacitance change ratio is reduced.

Therefore, J. Park et al. has proposed not a structure in which an electrode formed out of (metal-dielectric) is brought into contact with an electrode formed out of metal, but a structure in which an electrode formed out of (metal-dielectric-metal) is resistively coupled with an electrode formed out of metal. According to this structure, even if the surface accuracy in a metal layer is not sufficient, an insulating layer will be formed along the surface of an electrode when the electrode is formed. Further, a metal layer will be formed along the insulating layer. Thus, the substantial distance between the electrodes can be reduced without being affected by the surface accuracy.

There has been proposed another MEMS switch using a single metal layer and assembled to be displaced in a plane parallel to a substrate surface (Patent Document 1). This MEMS switch is constituted by at least one air bridge including a movable electrode disposed adjacently to a fixed electrode. A movable electrode having a three-layer structure made of metal layers with a dielectric layer formed in the coupling surface. The dielectric layer is, for example, a silicon oxide film, a silicon nitride film, or the like. This movable electrode is driven by an electro static force so as to be displaced in a plane parallel to the substrate surface. In this structure, the electrodes can be formed out of a single metal layer because the movable electrode is driven in a plane parallel to the substrate surface. However, the contact is based on metal-to-dielectric coupling.

Further, there has been proposed not an MEMS switch in which a movable contact itself is driven but an MEMS switch in which a beam connected to the movable contact is driven by a driving electrode provided on the substrate surface (Patent Document 2).

Non-Patent Document 1: J. Park et al., "Electroplated RF MEMS Capacitive Switches" IEEE MEMS 2000

Patent Document 1: U.S. Pat. No. 6,218,911B1

Patent Document 2: JP-A-2003-71798

DISCLOSURE OF THE INVENTION

Problems that the Invention is to Solve

In a capacitive coupling type MEMS switch having a structure in which a movable electrode made of metal is brought into contact with a dielectric layer formed on a fixed electrode, as described previously, when the surface roughness of the dielectric layer or the metal layer is rough, the capacitive coupling area is degraded so that the ON/OFF capacitance ratio becomes low. Thus, there has been a problem that a sufficient high-frequency characteristic cannot be obtained overall. On the other hand, an MEMS switch disclosed in Non-Patent Document 1 is to solve this point. That is, there has been proposed an MEMS switch in which a fixed electrode is formed by sandwiching a dielectric layer between two metal layers, and ON/OFF is attained by contact between the top metal layer of the fixed electrode and a movable electrode made of a metal layer. In this structure, lowering of capacitance caused by the surface roughness can be prevented due to the metal-to-metal contact. Thus, a good contact can be obtained.

However, in this MEMS switch, there has been a problem as follows. That is, there has been problem that an electrode region for switching a signal by capacitive coupling and an electrode region for applying an electrostatic force to the movable electrode must be disposed independently of each other. Since the electrode for switching a signal is based on resistive coupling, the electrode has the same potential as that of the movable electrode when the electrode abuts against the movable electrode. Thus, no electrostatic force is generated. Therefore, another independent electrode is required for driving the movable electrode.

Such a control electrode must be disposed outside the switch body, and must be formed on the lower layer side or on the upper layer side so as to be able to apply a larger electrostatic force than an electrostatic force between the fixed electrode and the movable electrode. It is therefore very difficult to dispose the control electrode, and it is difficult to realize the control electrode.

Furthermore, this structure requires three different metal layers, that is, the fixed electrode (signal line), the top metal layer (metal layer) deposited on the fixed electrode, and the movable electrode (metal layer). The step of manufacturing the switch body of these metal layers is complicated. In addition, there is a problem that arrangement of the control electrode makes the structure more complicated.

On the other hand, in the Patent Document 1, a beam corresponding to a movable electrode is driven horizontally so that a pattern is formed perpendicularly to the substrate surface. Thus, the fixed electrode and movable electrode are formed out of one and the same layer. Accordingly, the fixed electrode and the movable electrode can be obtained by a filming step and a patterning step of a single metal layer. The problems in the manufacturing process are solved widely.

This structure is characterized in that manufacturing can be made easily because a movable electrode and a fixed electrode can be formed by a single metal layer. However, in this structure, capacitive coupling is formed by contact using an electrostatic force. Accordingly, the following problem is left unsolved as it is. That is, a sufficient ON capacitance cannot be obtained when the surface accuracy deteriorates in the surface. Thus, a final ON/OFF capacitance ratio cannot be obtained.

On the other hand, Patent Document 2 has proposed a technique in which a driving electrode is fixedly formed on a silicon substrate, and a voltage is applied to this driving electrode in the same manner as the control electrode, so that beams disposed to put the driving electrode there between are displaced in a direction parallel to the silicon substrate so as to allow movable contacts to abut against each other. In this example, the movable contacts are formed to move horizontally. However, the driving electrode does not drive the movable contacts directly but drives the movable contacts by displacing the beams disposed closely to this driving electrode and at a predetermined gap therefrom. Here, the driving electrode serves as an anchor portion.

When a driving electrode is provided separately thus, the occupied area increases on a large scale so as to prevent the MEMS switch from being more microscopic.

The present invention was developed in consideration of the situation. An object of the present invention is to provide an MEMS switch easy to manufacture, microscopic, and capable of obtaining a sufficient ON/OFF capacitance ratio.

Means for Solving the Problems

In order to attain the foregoing object, an MEMS switch according to the present invention is an MEMS switch comprising a substrate, a conductive beam formed on a surface of the substrate, and a three-layer structure beam formed on the surface of the substrate and disposed to be opposed to the conductive beam, wherein the three-layer structure beam includes a first conductive layer, a second conductive layer and a dielectric layer sandwiched between the first conductive layer and the second conductive layer, the first conductive layer is opposed to the conductive beam, at least one of the conductive beam and the three-layer structure beam is displaced on a plane parallel to the substrate due to an electrostatic force so that the conductive beam and the first conductive layer can come into contact with each other, and a conductive path is formed between the conductive beam and the second conductive layer when the conductive beam and the first conductive layer are in contact with each other.

With this configuration, capacitance can be formed easily by a metal-to-metal contact without depending on the surface roughness. Even when the first conductive layer of the three-layer structure beam and the conductive beam are attracted and brought into contact with each other due to an electrostatic force, the second conductive layer can provide a stronger electrostatic force easily so as to attract the conductive beam due to the electrostatic force while keeping the contact state without separating the first conductive layer and the conductive beam from each other. In addition, these three-layer structure beam or conductive beam are arranged to be displaced in a plane parallel to the substrate. Accordingly, the three-layer structure beam and the conductive beam can be formed out of one and the same layer. Even when the second conductive layer is formed to be larger than the first conductive layer, there is no fear that excessive gravitational stress is applied, but stable driving can be kept for a long term. Although a separated control electrode is required to keep the contact state in a metal-to-metal contact by an electrostatic force, a conductive member corresponding to this control electrode can be also used as a second conductive layer of a capacitor in such a manner. That is, since a metal-to-metal contact can be obtained without providing another control electrode, switching can be performed between an input terminal and an output terminal formed out of the conductive beam and the second conductive layer. Thus, it is possible to obtain an MEMS switch which is microscopic and easy in structure.

The MEMS switch according to the present invention also includes an MEMS switch wherein a dielectric formation surface of the second conductive layer has irregularities.

With this configuration, in addition to the effects, the area of a region where the dielectric layer is surrounded by the first and second conductive layers increases so that the ON capacitance can be increased without increasing the occupied area.

The MEMS switch according to the present invention also includes an MEMS switch wherein a surface of the second conductive layer on the dielectric layer side has irregularities.

With this configuration, in addition to the effects, the area of a capacitor structure where the dielectric layer is sandwiched between the first and second conductive layers can be increased so that the ON/OFF capacitance ratio can be increased.

The MEMS switch according to the present invention also includes an MEMS switch wherein the first conductive layer and the second conductive layer are disposed to be parallel.

With this configuration, the capacitor area can be increased, and the electrostatic force can be applied efficiently.

The MEMS switch according to the present invention also includes an MEMS switch wherein at least one protrusion portion is provided in the dielectric-side surface, and the first conductive layer is provided in the protrusion portion.

With this configuration, the surface area increases by virtue of the provision of the protrusion portion in the surface. Since the first conductive layer is formed in the protrusion portion, the capacitor area forming the capacitance can be increased without reducing the ON capacitance.

The MEMS switch according to the present invention also includes an MEMS switch wherein the first conductive layer is provided only in the protrusion portion.

With this configuration, the second conductive layer faces the conductive beam through the dielectric layer or abuts against the conductive beam in a region excluding the protrusion portion. Thus, the electrostatic force can be applied so that this contact state can be kept even after the first conductive layer and the conductive beam come into contact with each other.

The MEMS switch according to the present invention also includes an MEMS switch wherein the electrostatic force is applied between the second conductive layer and the conductive beam.

The MEMS switch according to the present invention also includes an MEMS switch wherein the electrostatic force is applied even when the conductive beam and the first conductive layer are in contact with each other.

The MEMS switch according to the present invention also includes an MEMS switch wherein the electrostatic force applied when the conductive beam and the first conductive layer are in contact with each other is at least as high as an enough force to keep the contact between the first conductive layer and the conductive beam. That is, the electrostatic force applied when the conductive beam and the first conductive layer are in contact with each other is made as high as or higher than an enough force to keep the contact between the first conductive layer and the conductive beam.

With this configuration, there is no fear that the first conductive layer and the conductive beam are separated from each other after they once come into contact with each other. Thus, a sufficient contact can be kept.

The MEMS switch according to the present invention also includes an MEMS switch wherein the electrostatic force applied when the conductive beam and the first conductive layer are in contact with each other is generated in a region of the conductive beam which is not in contact with the first conductive layer.

With this configuration, the electrostatic force enough to keep the state where the conductive beam is in contact with the first conductive layer can be applied between the second conductive layer and the conductive beam. For example, a region where the first conductive layer is not formed is formed so that the region is disposed opposite to the conductive beam without putting the first conductive layer therebetween. Only when such a region where the first conductive layer-is not formed is formed, the contact state can be kept without providing a control electrode or driving electrode separately.

That is, this structure is a structure in which ON capacitance is secured by a capacitance securing region forming a metal-to-metal contact between the first conductive layer and the conductive beam, and an electrostatic force securing region for keeping the contact state between the conductive beam and the three-layer structure beam is formed out of a dielectric-to-metal contact region or a dielectric-to-metal close region between the dielectric layer on the second conductive layer and the conductive beam, so that securing the capacitance and securing the electrostatic force are attained by the different regions of the same three-layer structure beam.

The MEMS switch according to the present invention also includes an MEMS switch wherein the second conductive layer is formed to be larger than the first conductive layer, and the second conductive layer includes a region opposed to the conductive beam without putting the first conductive layer therebetween.

With this configuration, when the conductive beam abuts against the first conductive layer, the potential of the conductive beam becomes equal to the potential of the first conductive layer so that no electrostatic force is applied. Thus, the conductive beam and the first conductive layer are to be separated from each other. For example, however, the region disposed opposite to the conductive beam without putting the first conductive layer therebetween can be formed so that an electrostatic force enough to keep the contact state can be applied between the second conductive layer and the conductive beam.

The MEMS switch according to the present invention also includes an MEMS switch wherein the second conductive layer includes at least one protrusion surface in its surface opposed to the conductive beam, and the dielectric layer is formed integrally with the surface, while the first conductive layer is formed in the protrusion portion.

With this configuration, manufacturing can be made easy, and the surface area can be increased due to the provision of the irregularities in the surface. Due to the first conductive layer formed in the protrusion portion, the capacitor area forming the capacitance can be increased without reducing the ON capacitance.

The MEMS switch according to the present invention also includes an MEMS switch wherein the second conductive layer can abut against the conductive beam through the dielectric layer in a region excluding the protrusion portion so as to form capacitive coupling.

With this configuration, when the conductive beam and the three-layer structure beam come into contact with each other in the ON state, not only the capacitance formed by the overlapping region of the first conductive layer and the second conductive layer but also the capacitance formed by the overlapping region of the second conductive layer and the conductive beam are applied. Thus, another driving power does not have to be provided, but sufficient capacitance can be obtained, and the MEMS switch can be made more microscopic.

The MEMS switch according to the present invention also includes an MEMS switch further comprising another three-layer structure beam, wherein the conductive beam is sandwiched between the two three-layer structure beams, the second conductive layer of one of the three-layer structure beams forms an RF output terminal, while the second conductive layer of the other three-layer structure beam is connected to ground potential, and at least one of the conductive beam and the three-layer structure beams is displaced on a plane parallel to the substrate due to an electrostatic force so that the conductive beam and the first conductive layer can come into contact with each other, and a conductive path is formed between the conductive beam and the second conductive layer when the conductive beam and the first conductive layer are in contact with each other.

With this configuration, capacitive coupling can be formed even in the OFF state. Accordingly, it is possible to obtain a more stable MEMS switch in which malfunction can be reduced even in use in an RF frequency band.

The MEMS switch according to the present invention also includes an MEMS switch wherein the substrate is a silicon substrate.

With this configuration, the MEMS switch can be formed easily using a normal semiconductor process, and integrated with other circuit devices easily.

The MEMS switch according to the present invention also includes an MEMS switch wherein the substrate is a GaAs substrate.

With this configuration, the MEMS switch can be integrated with optical devices etc. easily.

The MEMS switch according to the present invention also includes an MEMS switch wherein the substrate is a glass substrate.

When a liquid crystal substrate or the like is formed, a silicon thin film is formed and the MEMS switch is formed in this silicon thin film. Thus, the MEMS switch can be integrated with other circuit devices easily.

The MEMS switch according to the present invention also includes an MEMS switch wherein the surface of the substrate is coated with an insulating layer.

The MEMS switch according to the present invention also includes an MEMS switch wherein the first and second conductive layers of the three-layer structure beam and the conductive beam include conductive layers formed in one and the same process.

With this configuration, a microscopic and high-definition MEMS switch can be obtained with an extremely simple configuration.

The MEMS switch according to the present invention also includes an MEMS switch wherein the conductive beam is formed as a fixed beam. With this configuration, connection of a signal line becomes easy.

The MEMS switch according to the present invention also includes an MEMS switch wherein the conductive beam is formed as a movable beam. With this configuration, the conductive beam is of a single layer and light in weight so that the conductive beam can be driven by a small electrostatic force.

The MEMS switch according to the present invention also includes an MEMS switch wherein the three-layer structure beam is formed as a movable beam. With this configuration, both the conductive beam and the three-layer structure beam can be displaced so that the distance of displacement of each beam can be reduced to half.

The MEMS switch according to the present invention also includes an MEMS switch wherein the three-layer structure beam is formed out of a vertical three-layer structure.

With this configuration, manufacturing can be made easy, and the flatness of the surface can be improved. Thus, the MEMS switch can be integrated with other circuit devices easily.

The MEMS switch according to the present invention also includes an MEMS switch wherein a driven surface of the three-layer structure beam is formed across the three-layer structure beam in a longitudinal direction of the three-layer structure beam.

It is desired that the driven surface is parallel to the substrate surface. The driven surface is not always parallel to the substrate surface, but it may be formed in the longitudinal direction. For example, an electrode, a dielectric layer and an electrode may be laminated along a side wall of a trench so that the driven-surface will be perpendicular to the lamination direction of the three-layer structure beam (body)

The MEMS switch according to the present invention also includes an MEMS switch wherein the overlapping area of the conductive beam and the three-layer structure beam is prevented from depending on the open/close state of the conductive path between the RF input terminal and the RF output terminal.

With this configuration, the degree of freedom in design is improved.

Effect of the Invention

In the MEMS switch according to the present invention, a signal line itself is displaced by an electrostatic force so as to be driven on a plane parallel to the substrate surface. Accordingly, it is not necessary to provide another control electrode, but the driving voltage can be reduced without giving up the microscopic size of the MEMS switch.

In addition, the driving voltage can be further reduced without any sacrifice of the surface area of the substrate only when the thickness of the beam is increased so that a larger operating region can be obtained.

In addition, in this MEMS switch, a satisfactorily large ON/OFF capacitance ratio can be obtained without depending on the surface roughness of contact regions.

Further, the beam laid like an air bridge and the conductive portions of the two three-layer structure capacitors can be formed out of one and the same metal layer. Accordingly, it is possible to provide a switch easy in structure and low in manufacturing cost.

BRIEF DESCRIPTION OF THE DRAWINGS

[FIG. 2] A diagram showing the state where the same MEMS switch is ON.

DESCRIPTION OF REFERENCE NUMERALS AND SIGNS

Figure 1:
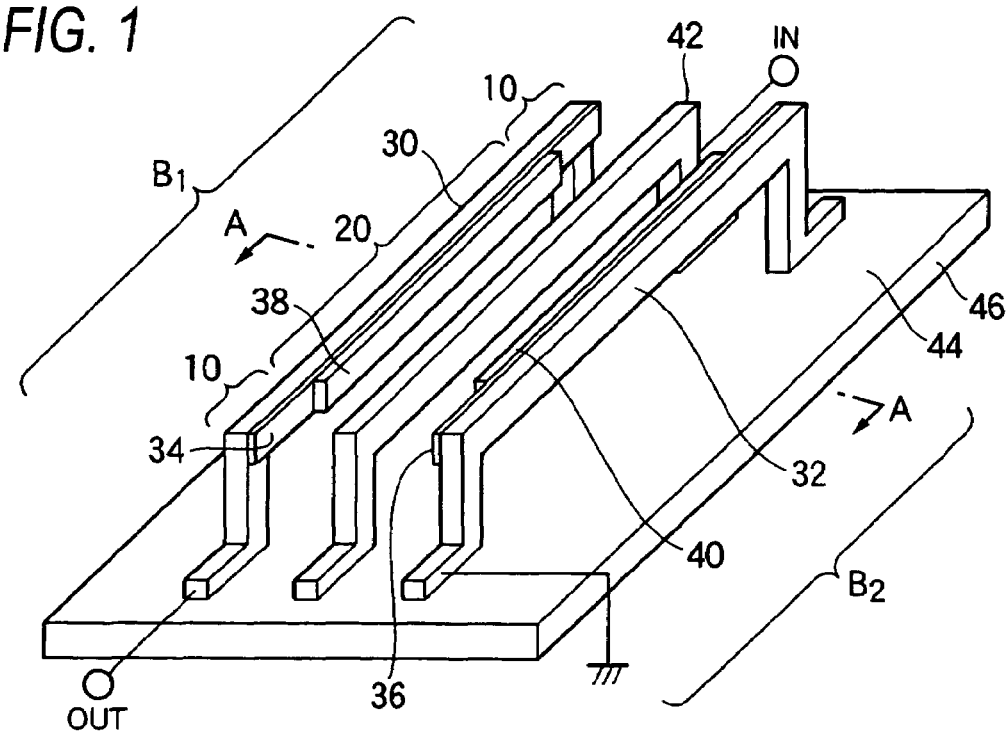
[FIG. 1] A perspective view of an MEMS switch according to Embodiment 1 of the present invention.

B1 first three-layer structure beam
B2 second three-layer structure beam
30 second conductive layer forming the first three-layer structure beam
32 second conductive layer forming the second three-layer structure beam
34, 36 dielectric layer
38 first conductive layer forming the first three-layer structure beam
40 first conductive layer forming the second three-layer structure beam
42 conductive beam
44 silicon oxide film (insulating film)
46 silicon substrate (substrate)

50, 52 metal contact portion
60 substrate
62 silicon oxide film
64 first photo-resist
66 silicon nitride film (dielectric layer)
68 second photo-resist
70 metal layer
72 third photo-resist
80 driven surface
82 metal-to-metal contact surface
84 capacitance region
86 driven surface

BEST MODE FOR CARRYING OUT THE INVENTION

Embodiments of the present invention will be described in detail with reference to the accompanying drawings.

Embodiment 1

This MEMS switch is formed by processing a silicon substrate 1 by MEMS technology. As shown in FIG. 1, the MEMS switch is formed so that air bridges are arranged in the surface of a silicon substrate 46. The MEMS switch is constituted by a conductive beam 42, and first and second three-layer structure beams B1 and B2 each having a capacitor structure. The conductive beam 42 and the three-layer structure beam B1 are connected to an input terminal and an output terminal respectively, and further the three-layer structure beam B2 is grounded. Each of these first and second three-layer structure beams is formed by sandwiching a dielectric layer between a first conductive layer 38, 40 and a second conductive layer 30, 32. Then, the first and second three-layer structure beams B1 and B2 having this conductive beam 42 put therebetween are displaced due to an electrostatic force on a plane parallel to the substrate so that the conductive beam 42 and the first conductive layer 38 or 40 can abut against each other on a plane parallel to the substrate surface. When the conductive beam abuts against the first conductive layer 38 or 40, a conductive path is formed between the conductive beam and the second conductive layer 30 or 32. Thus, a switching function is implemented. In each of these first and second three-layer structure beams B1 and B2, the dielectric layer 34, 36 is sandwiched between the first conductive layer 38, 40 opposed to the conductive beam 42 and the second electrode 30, 32 disposed outside, so as to form a capacitor.

Here, the conductive beam and the first and second conductive layers are formed out of metal layers formed in one and the same process.

When this MEMS switch is ON, the first three-layer structure beam B1 and the conductive beam 42 attract each other due to an electrostatic force so as to be displaced and brought into contact with each other. A signal input from the input terminal is output to the output terminal through the conductive beam 42 and the three-layer structure beam B1.

On the other hand, when the MEMS switch is OFF, the conductive beam 42 abuts against the first conductive layer 40 of the second three-layer structure beam B2 so as to form a conductive path between the conductive beam and the second conductive layer 32 of the three-layer structure beam. In this event, an input signal is grounded so that higher isolation can be secured. In such a manner, a switching operation is implemented.

Incidentally, here, in order to minimize parasitic capacitance, the surface of the silicon substrate 46 is coated with a silicon oxide film 44, and the MEMS switch is formed on this silicon oxide film 44.

Figure 2:
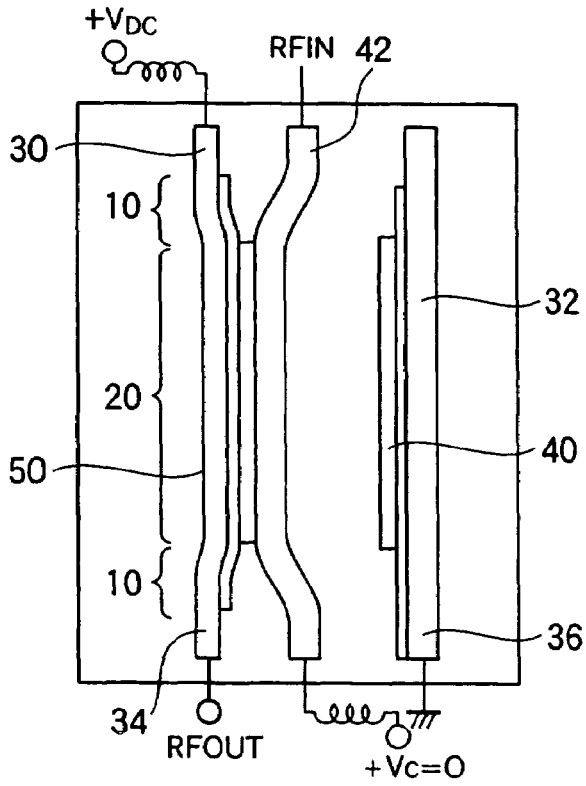
Figure 3:
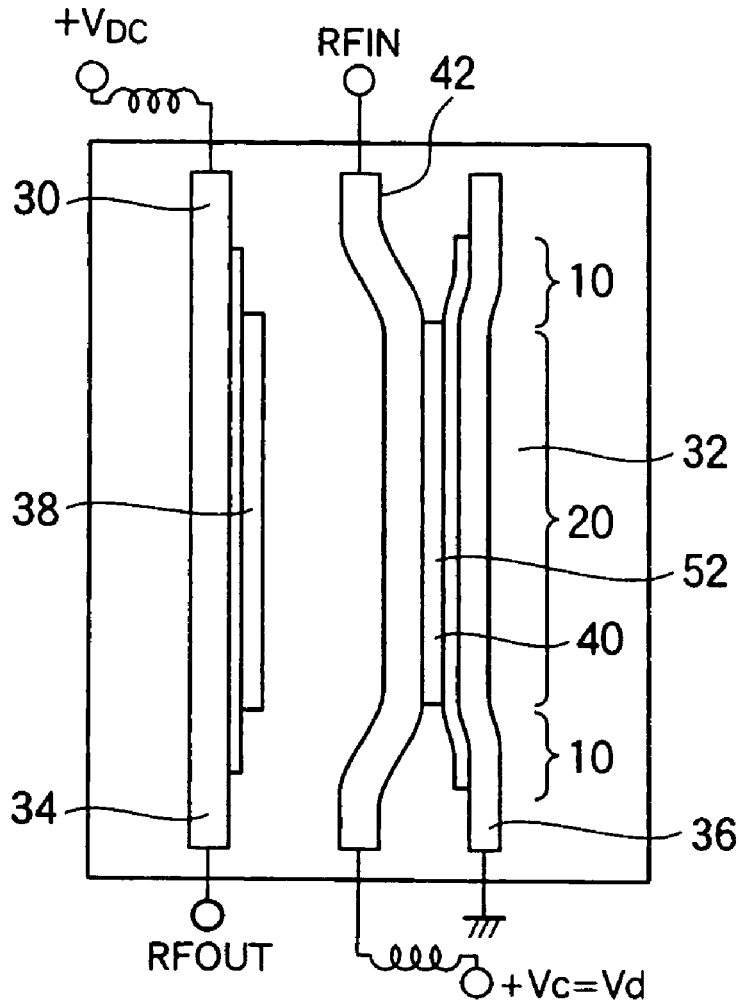
[FIG. 3] A diagram showing the state where the same MEMS switch is OFF.

Next, the ON/OFF operation of this MEMS switch will be described with reference to FIG. 2 and FIG. 3. FIG. 2 is a diagram showing the state where the MEMS switch is ON, and FIG. 3 is a diagram showing the state where the MEMS switch is OFF. The potential of the second conductive layer 30 of the first three-layer structure beam B1 and the potential of the second conductive layer 32 of the second three-layer structure beam B2 are always set at Vdc and ground potential respectively. Here, as shown in FIG. 2, in order to turn this MEMS switch ON, potential Vc applied to the conductive beam 42 through an inductor is set at the ground potential. The potential difference between the conductive layer 30 and the conductive beam 42 in this event reaches Vd so that the conductive beam 42 and the-first three-layer structure beam B1 are displaced due to the electrostatic force between the conductive layer 30 of the first three-layer structure beam B1 and the conductive beam 42 so as to form a metal-to-metal contact. Consequently a signal input from the input terminal is output as an output signal through the conductive beam 42 and the second conductive layer of the first three-layer structure beam B1.

In this structure, due to use of the metal-to-metal contact, ideal ON capacitance can be obtained without forming smooth contact surfaces. In other words, as long as the impedance of this metal-to-metal contact is low enough not to limit any factor of insertion loss in RF characteristic, ON capacitance can be obtained by some DC contacts. Here, when the MEMS switch is in an ON position shown in FIG. 2, ON capacitance Con can be expressed by Con=eo*er*A50/d34. Here, A50 designates the area of a metal contact portion 50, and d34 designates the thickness of the dielectric layer 34.

Likewise FIG. 3 is a diagram showing the state where the MEMS switch is OFF. Here, as shown in FIG. 3, in order to turn this switch OFF, potential Vd is applied to +Vc to the conductive beam 42. In this event, the potential of the second conductive layer 32 of the second three-layer structure beam B2 is the ground potential. Accordingly, due to the electrostatic force with the conductive beam 42, the conductive beam 42 and the second three-layer structure beam B2 are displaced to approach each other so as to form a metal-to-metal contact. Consequently the conductive beams 42 and the three-layer structure beam B1 are brought into an open state, and further the conductive beam 42 abuts against the three-layer structure beam B2 so as to be grounded. As a result, higher isolation can be obtained.

Next, a process of this MEMS switch will be described with reference to FIGS. 4 to 9.

A semiconductor substrate of silicon or the like is used as a substrate 60 on which MEMS is implemented. Here, description will be made on the case where a silicon substrate is used.

Figure 4:
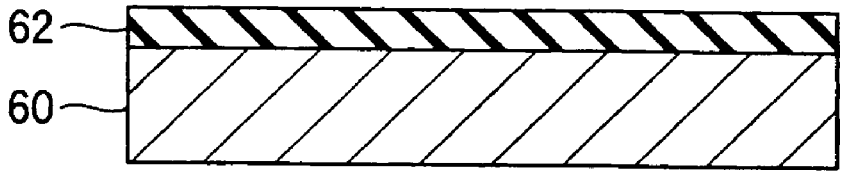
[FIG. 4] A manufacturing process diagram of the MEMS switch according to Embodiment 1 of the present invention.

First, as shown in FIG. 4, a silicon oxide film 62, for example, 300 nm to 1 μm thick, is formed on the silicon substrate surface by a CVD method or the like.

Figure 5:
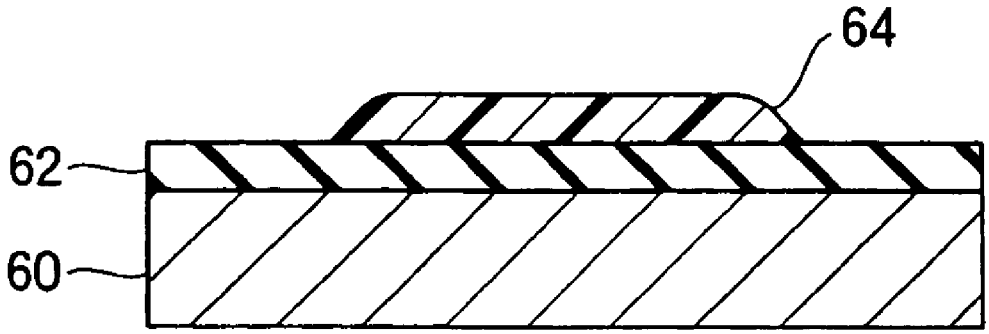
[FIG. 5] A manufacturing process diagram of the MEMS switch according to Embodiment 1 of the present invention.

Then, as shown in FIG. 5, the silicon oxide film 62 is coated with a photo-resist as a sacrificial layer by spin coating, and a first pattern 64 is formed by exposure and development with a desired mask. It is desired that this photo-resist is 1-3 μm thick. This thickness is a factor defining the distance between the substrate and each of the conductive beam and the first and second three-layer structure beams B1 and B2. In order to form beam support portions of the conductive beam 42 and the three-layer structure beams B1 and B2 smoothly, the shape of the photo-resist as a sacrificial layer is made smooth. To this end, post-baking is performed at a desired temperature, for example, at about 180° C. This temperature differs in accordance with the composition of the photo-resist used. If the post-baking temperature is too high, the photo-resist will be too smooth. If the post-baking temperature is too low, the photo-resist will be angular. It is therefore important to optimize this post-baking temperature.

Figure 6:
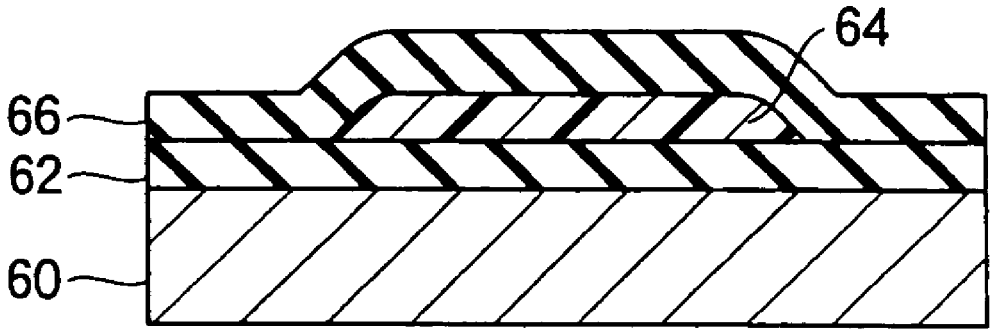
[FIG. 6] A manufacturing process diagram of the MEMS switch according to Embodiment 1 of the present invention.

Successively, as shown in FIG. 6, a silicon nitride film 66 having a film thickness of 1-3 μm is deposited, for example, by a CVD method or the like.

After that, a photo-resist is applied by spin coating, and a second photo-resist 68 is formed as an upper layer on the silicon nitride film 66 by exposure such as electron beam exposure, X-ray exposure, stepper exposure with resolution of submicron order, or the like, and development.

Figure 7:
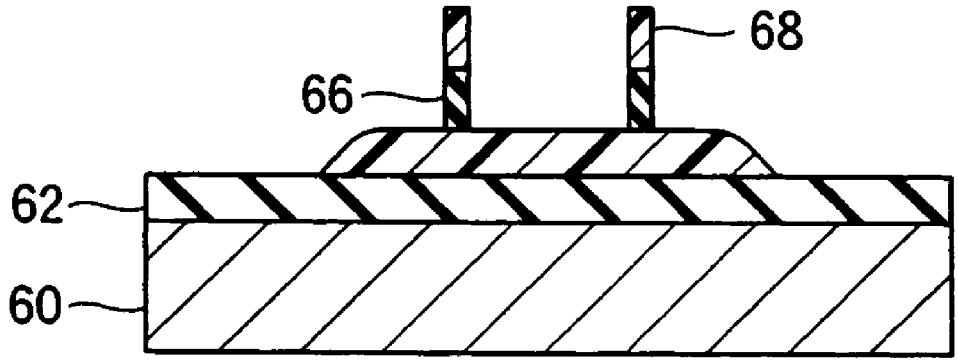
[FIG. 7] A manufacturing process diagram of the MEMS switch according to Embodiment 1 of the present invention.

After that, as shown in FIG. 7, the silicon nitride film 66 is patterned with this second photo-resist 68 as a mask by dry etching using plasma. In this event, it is desired to use dry etching because it is easy to control an undercut as compared with wet-etching using phosphoric acid or the like as an etchant. Here, when an insulating film other than the silicon nitride film is used, it is desired to select dry etching or wet etching as suitable one to be used in accordance with the insulating film material. This process defines the thickness of the dielectric layers of the three-layer structure beams, that is, the capacitances of the capacitors of the first and second three-layer structure beams. It is therefore necessary to pay attention to this process as to whether a precise pattern can be formed or not.

The width of the silicon nitride film 66 forming the dielectric layers should be kept as small as possible in order to minimize the OFF capacitance and maximize the ON/OFF capacitance change ratio.

After the pattern of the silicon nitride film 66 forming the dielectric layers is formed thus, a metal layer 70 of gold or the like is formed to be approximately as thick as the dielectric layers (1-3 μm in the example of FIG. 6) by use of an electron beam evaporator or the like. Here, it is desired to deposit the metal layer 70 in the state where the second photo-resist 68 used for patterning the silicon nitride film 66 forming the dielectric layers are left as it is. When the metal layer 70 is deposited thus in the state where the pattern of the second photo-resist 68 are left as it is, this second photo-resist 68 can be removed effectively by a lift-off method even if the metal layer is formed in an undesired region such as the upper surface etc. of the pattern of the silicon nitride film 66 forming the dielectric layers.

Figure 8:
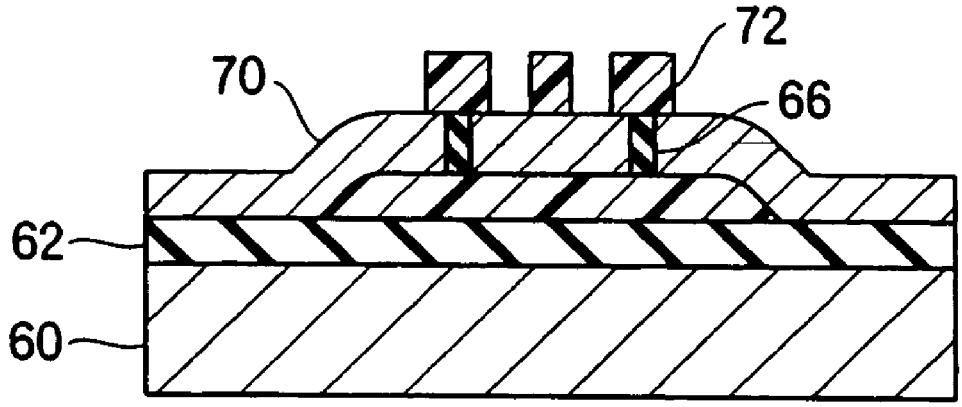
[FIG. 8] A manufacturing process diagram of the MEMS switch according to Embodiment 1 of the present invention.

Next, as shown in FIG. 8, a third photo-resist is applied by spin coating, and a pattern of the third photo-resist 72 is formed by exposure and development with a desired mask.

Figure 9:
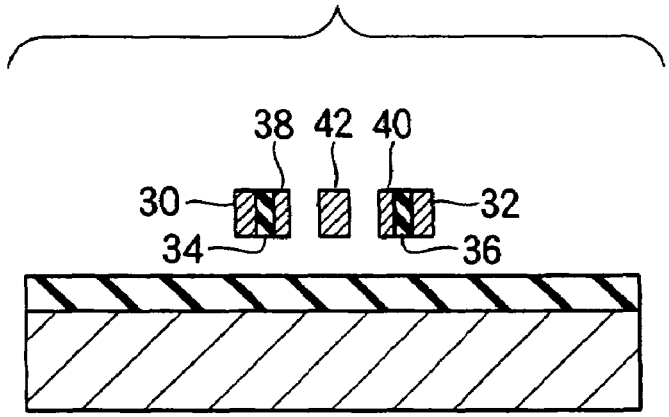
[FIG. 9] A manufacturing process diagram of the MEMS switch according to Embodiment 1 of the present invention.

Then, this metal layer 70 is etched by use of a dry etching technique such as RIE or the like. After that, the first and third photo-resists 64 and 72 are removed by ashing using oxygen plasma. Thus, as shown in FIG. 9, air-bridge-like beams are formed, and an air gap size of 0.6 to 2 μm is formed. FIG. 9 as a final diagram of this process is a sectional view taken on line A-A in FIG. 1 showing the MEMS switch.

Here, the first three-layer structure beam B1 is constituted by the second conductive layer 30 made of the metal layer 70, the beam-like dielectric layer 34 made of the silicon nitride film 66, and the first conductive layer 38 made of the metal layer 70. The conductive beam 42 is also formed out of the metal layer 70. Further, the second three-layer structure beam B2 is constituted by the second conductive layer 32 made of the metal layer 70, and the beam-like dielectric layer 36 made of the silicon nitride film 66.

In addition, in the MEMS switch formed thus, each beam is 500 μm long, 2 μm wide and 2 μm thick, and each first conductive layer 38, 40 is 1 μm wide and 400 μm long. The second electrode surface covered with the dielectric layer 34, 36 is exposed in the opposite end portions so as to form a region (electrostatic force securing region 10) opposed to the conductive beam 42.

When the conductive beam 42 abuts against the first conductive layer 38, this portion exposed from the first conductive layer serves to apply an electrostatic force enough to keep this state, and keep stably the state where the second conductive layer 30 attracts the conductive beam 42. That is, the second conductive layer plays a roll as an RF output terminal and a roll as a driving electrode (control electrode).

That is, here, the second conductive layer 30 as a second electrode coated with the dielectric layer 34, and each end portion of the conductive beam 42 may form metal-to-dielectric contact, or may be separated from each other while being attracted due to the electrostatic force. In either case, when the first conductive layer 38 and the conductive beam 42 form a contact, it will go well if the dielectric layer 34 on the second conductive layer 30 and the conducive beam 42 are close enough to keep the contact state between the conductive beam and the first conductive layer due to this electrostatic force. (This region forms an electrostatic force securing region 10 as will be described later.)

This solves the problem caused by use of a metal-to-metal contact. That is, a stable operation can be kept without providing a control electrode separately.

In other words, this structure is a structure in which ON capacitance is secured by a capacitance securing region 20 forming a metal-to-metal contact between the first conductive layer and the conductive beam, and a contact state between the conductive beam and the three-layer structure beam is secured by the electrostatic force securing region 10 for keeping the contact state based on a dielectric-to-metal contact region or a dielectric-to-metal close region between the dielectric layer on the second conductive layer and the conductive beam.

It is therefore possible to provide a high-reliability MEMS switch without preventing electrodes from being more microscopic.

Further, when the MEMS switch is formed by this method, the first and second conductive layers and the conductive beam are formed by a single metal layer. Accordingly, the thickness of the metal layer is constant.

In such a manner, the thickness can be controlled with extremely high precision so that a high reliability MEMS switch can be formed.

In the Embodiment 1, gold is used as the metal layer forming each electrode of the conductive beam and the three-layer structure films. The material is not limited to gold, but another metal material such as Mo, Ti, Al or Cu, a semiconductor material doped with impurities in high concentration, such as amorphous silicon, a conductive polymeric material, etc. may be used. Further, as for the method for forming the film, the film may be formed by use of a sputtering method, a CVD method, a plating method, etc. as well as an electron beam deposition method.

Further, although both the conductive beam and the three-layer structure beams are made movable in the Embodiment 1, only the conductive beam may be made movable.

Furthermore, although air bridges are formed to project over the substrate surface in the Embodiment 1, a trench may be contrariwise formed so that cantilever or arch beams can be formed to be laid across the trench.

Incidentally, it goes without saying that the MEMS switch according to the present invention is microscopic, capable of high-speed operation, and effective as a discrete element. The MEMS switch can be integrated together with other circuit elements. Thus, it is possible to provide a semiconductor integrated circuit device having an MEMS switch low in transmission loss, small in size and high in reliability.

In addition, the MEMS switch is formed with beams being formed on the substrate surface by way of example in the respective embodiments. Each embodiment can have such a configuration in which a trench having a desired sectional shape is formed in a substrate, and beams are left on this trench so as to serve as movable portions. Such a configuration can be formed and implemented easily by use of anisotropic etching of silicon or the like.

Furthermore, as for the substrate, a compound semiconductor substrate of GaAs or the like as well as a silicon substrate may be used if the electrode material is selected to be suitable to the substrate used. Integration with other circuit elements is extremely easy.

Embodiment 2

Figure 10:
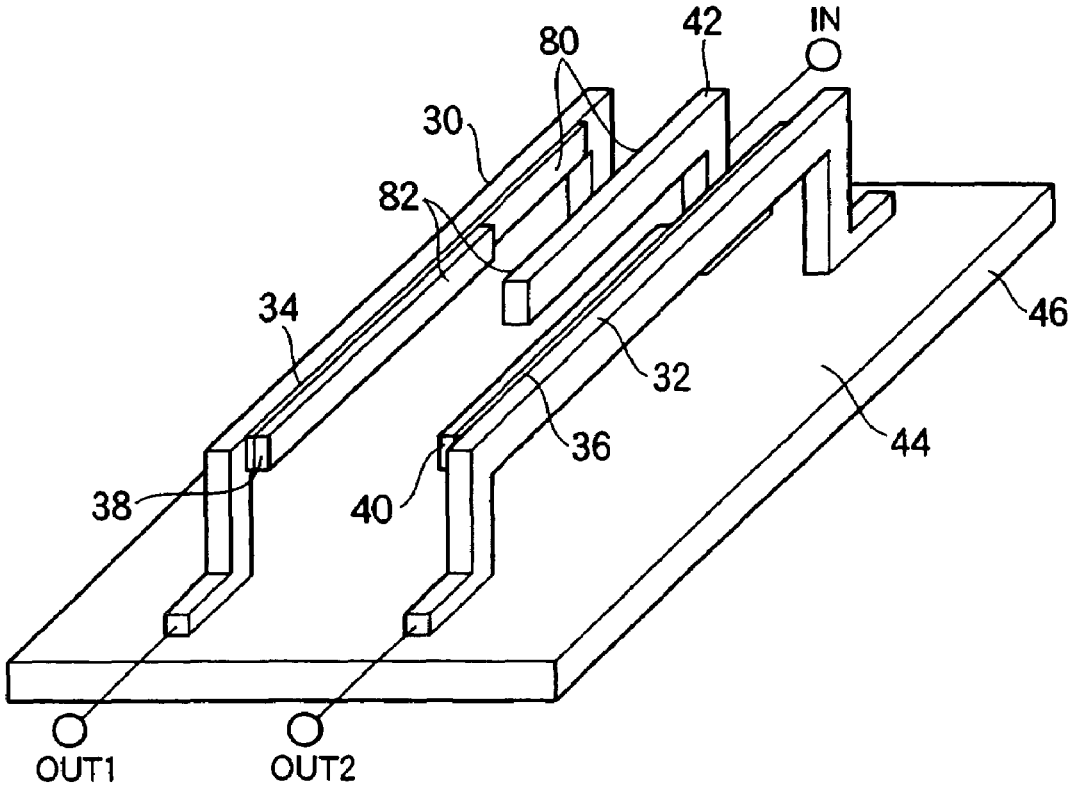
[FIG. 10] A perspective view of an MEMS switch according to Embodiment 2 of the present invention.

The driving method and the fundamental configuration of an MEMS switch according to this Embodiment 2 are similar to those in the Embodiment 1. All the beams are formed as arch beams in the Embodiment 1. However, as shown in FIG. 10, the MEMS switch according to Embodiment 2 is characterized in that the conductive beam 42 located in the center is formed to have a cantilever beam structure slight shorter than an arch beam. That is, as shown in FIG. 10, this MEMS switch is characterized in that the conductive beam 42 is made approximately half as long as any other beam, that is, 250 μm long.

The MEMS switch according to this embodiment is different from the MEMS switch according to the Embodiment 1 in that the second conductive layer 32 forming the second three-layer structure beam is not connected to the ground but connected to a second output terminal.

With this configuration, as soon as the conductive beam 42 abuts against either of the first three-layer structure beam and the second three-layer structure beam disposed on the left and right of the conductive beam 42, the switch shown in FIG. 10 is shifted from the OFF state to the ON state so as to form a conductive path.

In this structure, as is apparent from the following expression, the overlapping areas of the portions forming the ON/OFF capacitors are independent of each other. It is therefore possible to increase the ON/OFF capacitance change ratio.

$$C_{ON}/C_{OFF} = (eo*er*A_{ONoverlap}/d_{diel})/(eo*er*A_{OFFoverlap}/d_{air})$$

$$= (d_{air}*A_{ONoverlap})/(d_{diel}*A_{OFFoverlap})$$

Here, $A_{ONoverlap}>A_{OFFoverlap}$

In addition, since the areas of the overlapping portions are independent, an actually driven surface 80 can be formed to be larger than a metal-to-metal contact surface 82. Thus, the driving voltage can be reduced and the switching speed can be increased.

Figure 11:
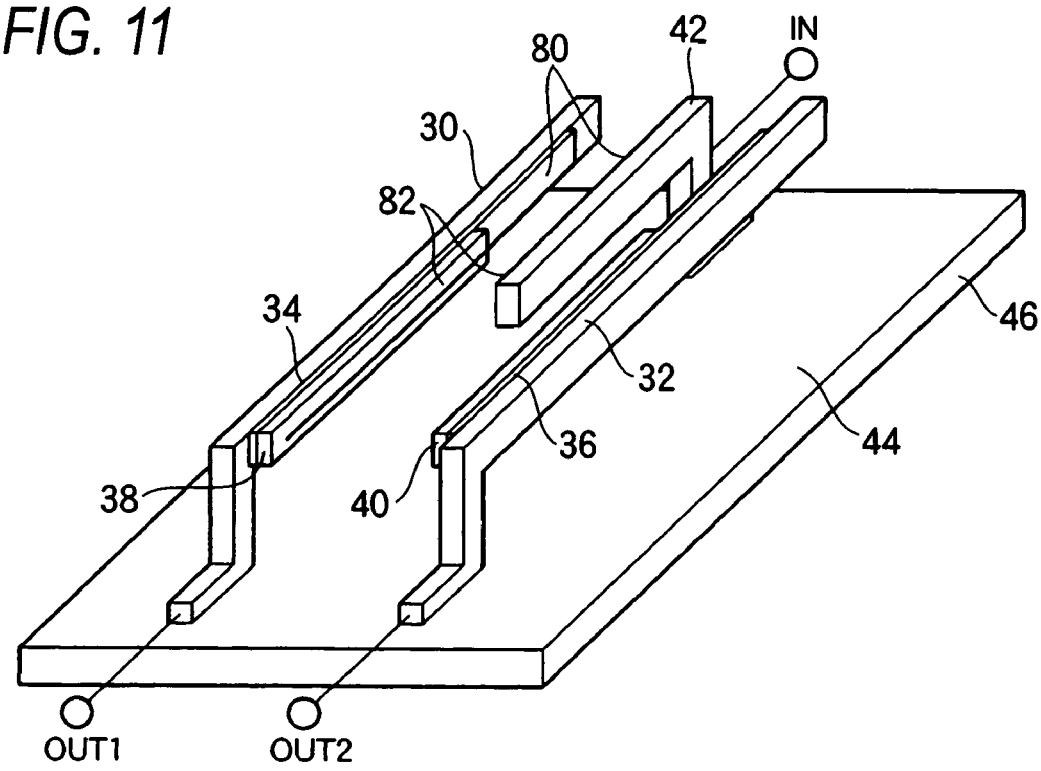
[FIG. 11] A perspective view of the MEMS switch according to Embodiment 2 of the present invention.

In addition, an MEMS switch according to a modification shown in FIG. 11 has a structure in which the ON/OFF capacitance change ratio can be increased in the same manner. The MEMS switch is slightly different from the MEMS switch according to Embodiment 2 shown in FIG. 10 in anchors of movable beams. That is, the three-layer structure beams on the opposite sides are formed as cantilever beams. Thus, all the beams are formed as cantilever beams.

When a uniform force is applied to all the beams of arch beams and cantilever beams, sprint constants can be expressed by the following comparison expressions.

$$k=32*E*t(w/l)\hat{3} \quad \text{(arch beam)}$$

$$k=2/3*E*t(w/l)\hat{3} \quad \text{(cantilever beam)}$$

Here, E designates a Young's modulus of a material, t designates beam thickness, w designates width, and l designates length.

From the aforementioned expressions, it is apparent that the spring constant of the cantilever beam is smaller than the spring constant of the arch beam. Accordingly, in the MEMS switch according to this modification shown in FIG. 11, the driving voltage can be reduced slightly and the switching speed can be increased as compared with the MEMS switch according to the example shown in FIG. 10.

Embodiment 3

Figure 12:
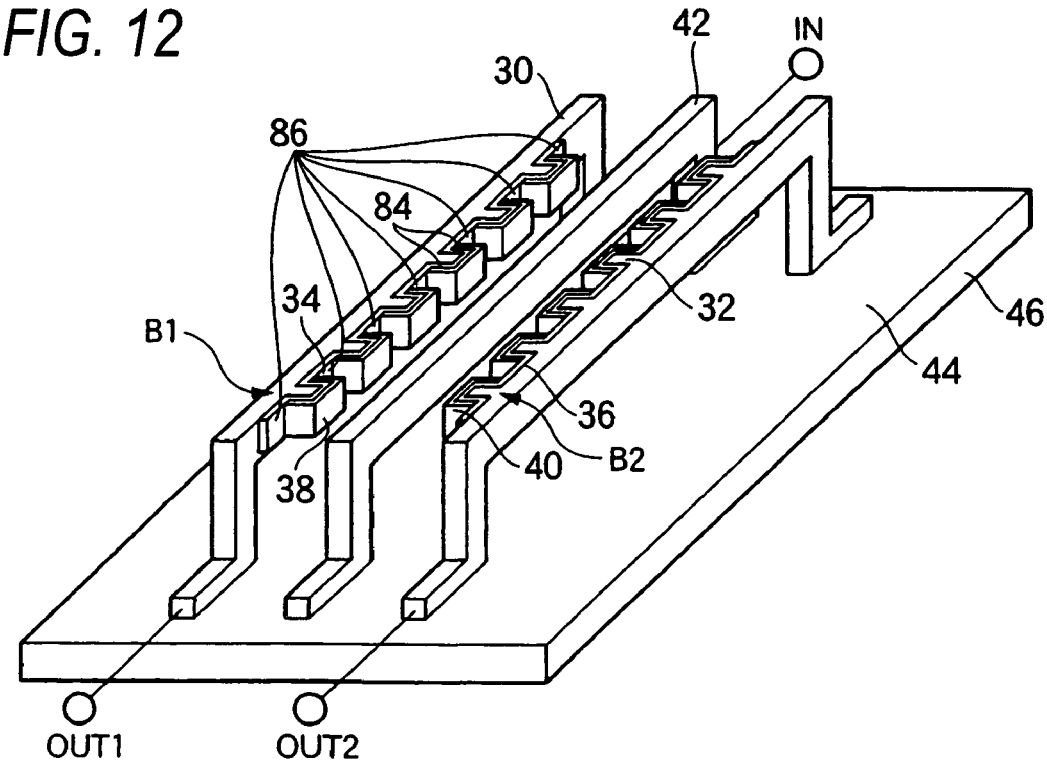
[FIG. 12] A perspective view of an MEMS switch according to Embodiment 3 of the present invention.

According to this embodiment, as shown in FIG. 12, protrusion portions serving as capacitance regions 84 and driven surfaces 86 are formed in the surfaces of the second conductive layers 30 and 32. FIG. 12 shows the OFF state. In the ON state, the conductive beam 42 abuts against a metal-to-metal contact surface 82 of each capacitance region so as to secure electric coupling.

Figure 14:
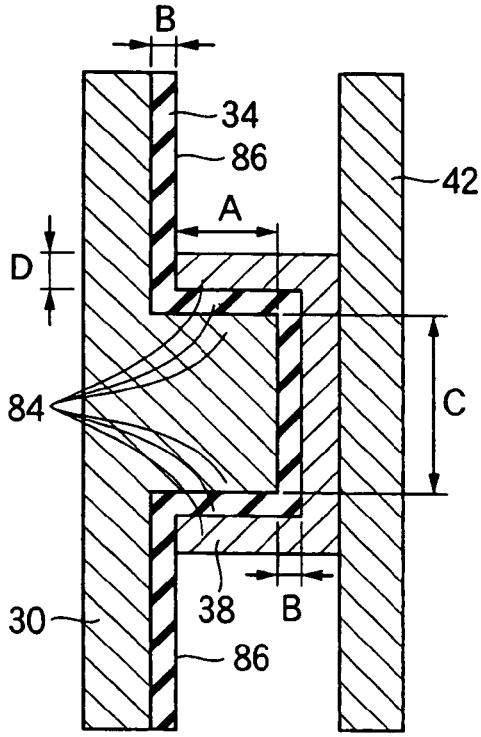
[FIG. 14] A main portion enlarged sectional view of the MEMS switch according to Embodiment 3 of the present invention.

Next, the coupling state in the ON state will be described. FIG. 14 is an enlarged view showing a contact surface in the ON state. The state where the conductive beam 42 abuts against the first conductive layer (first electrode) 38 of the first three-layer structure beam is shown. When the conductive beam 42 and the metal-to-metal contact surface 82 are displaced to abut against each other due to an electrostatic force, the potential of the first conductive layer 38 forming the first three-layer structure beam becomes equal to the potential of the conductive beam 42. Thus, a capacitance is formed through the dielectric layer 34 between the first conductive layer 38 forming the first three-layer structure beam and the second conductive layer forming the first three-layer structure beam. A designates the height of the protrusion portion (excluding film thickness B of the dielectric layer 34), B designates the film thickness of the dielectric layer 34, C designates the width of the protrusion portion, and D designates the film thickness of the first electrode.

Here, $C_{horiz}$ designating capacitance of a portion parallel to the conductive beam 42 is expressed by $C_{horiz}$=eo*er* ((C+2D)*t)/B, and $C_{vert}$ designating capacitance vertical to the conductive beam 42 is expressed by $C_{vert}$=eo*er* (2A*t)/B. In this event, capacitance in the ON state is expressed by $C_{ON}=C_{horiz}+C_{vert}$. Accordingly, when the shape of the electrode is changed, particularly when the value of A is changed, the capacitance in the ON state can be set at a desired value.

Figure 13:
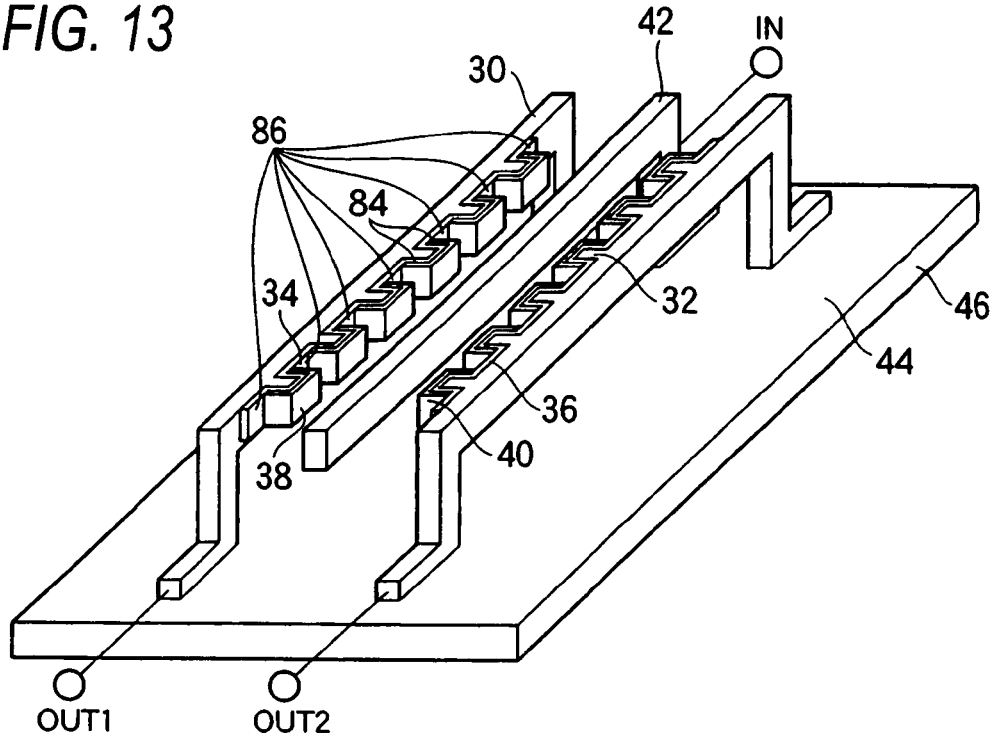
[FIG. 13] A perspective view of the MEMS switch according to Embodiment 3 of the present invention.

Next, the OFF state will be described. FIG. 12 shows the OFF state of the switch. The OFF capacitance is defined by the gap between the conductive beam 42 and the first three-layer structure beam B1, the gap between the conductive beam 42 and the second three-layer structure beam B 2 and the area of each capacitor forming portion. In the ON state, the area of the capacitor forming portion includes the capacitance region 84 of the three-layer structure beam. Therefore, the capacitance region 84 is reflected in the ON/OFF capacitance ratio. In addition, according to this embodiment, the ON capacitance is increased independently of the OFF capacitance. An example shown in FIG. 13 is similar to the example shown in FIG. 12. The example shown in FIG. 13 is different from the example shown in FIG. 12 in that the center conductive beam 42 connected to an RF input terminal and forming a signal line is formed as a cantilever beam. Here, not a comb-teeth-like structure in the related art but a linear beam is used as the conductive beam 42. As a result, there is an advantage that the gaps from the three-layer structure beams B1 and B2 can be expanded to further reduce the OFF capacitance.

Figure 17:
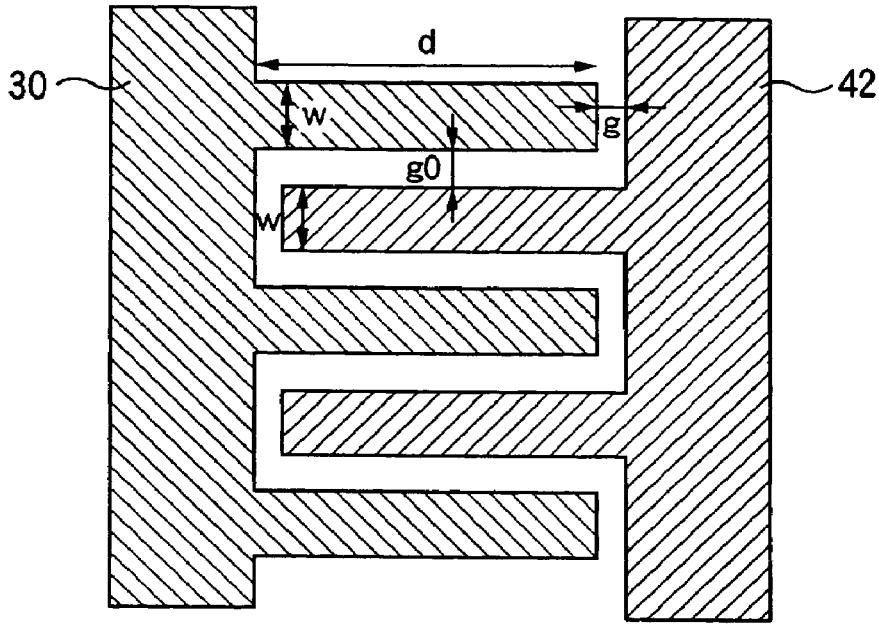
[FIG. 17] A main portion enlarged sectional view of a usual comb-teeth structure for explaining the present invention.
Figure 18:
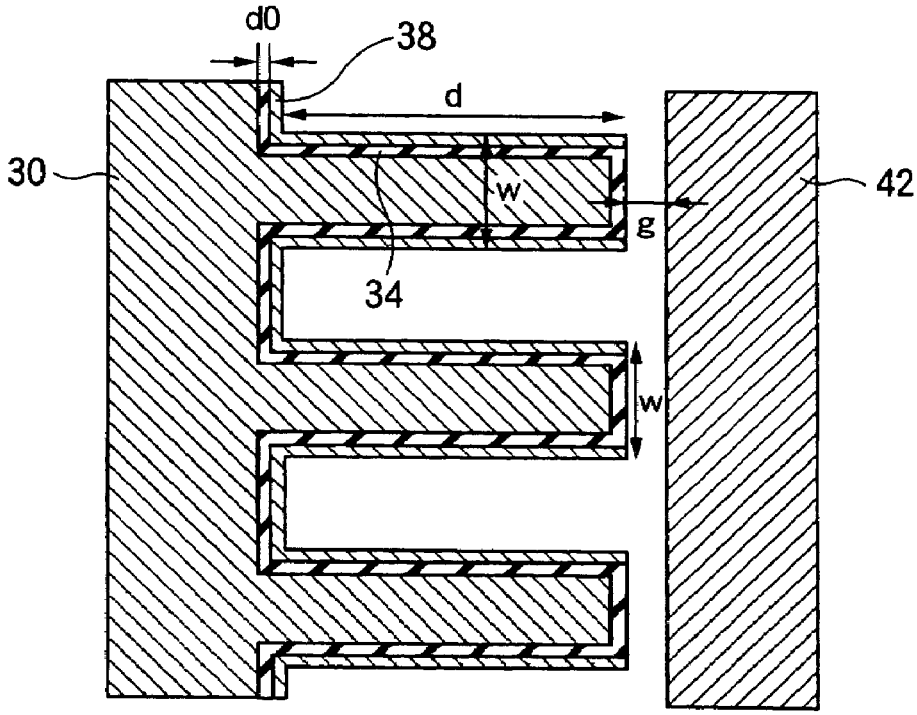
[FIG. 18] A main portion enlarged sectional view of the MEMS switch according to Embodiment 3 of the present invention.
Figure 19:
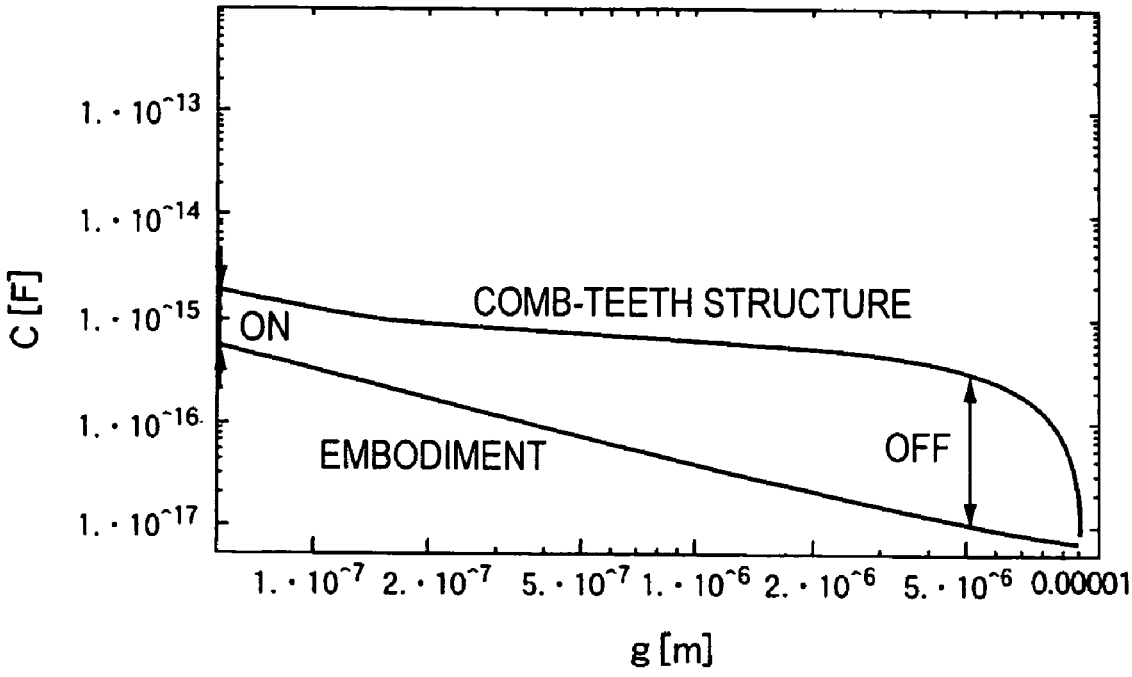
[FIG. 19] A graph showing a capacitance change ratio in the comb-teeth structure and a capacitance change ratio in the MEMS switch according to Embodiment 3.

This will be described in FIGS. 17, 18 and 19. FIG. 17 shows a related-art comb-teeth-like structure, and FIG. 18 shows this embodiment. FIG. 19 shows each capacitance change ratio when a gap (g) was changed. Here, length (d) and width (w) of each protrusion portion in FIGS. 17 and 18 were made 10 μm and 2 μm respectively, a comb-teeth interval (g0) of the comb-teeth structure in FIG. 17 was made 0.6 μm, and relative permittivity (Er) of the dielectric layer in FIG. 18 was made 10. As a result, as shown in FIG. 19, similar capacitances can be obtained in both the structures in the ON state, while the capacitance in the embodiment can be made smaller than that of the comb-teeth structure in the OFF (g=5E−6) state. Thus, the isolation characteristic of the switch can be improved.

That is, here again, the dielectric layer 34 on the second conductive layer 30 forming the driven surface 86 and the conductive beam 42 may form a metal-to-dielectric contact, or may be separated from each other while being attracted due to the electrostatic force. When the first electrode and the conductive beam forms a contact, it will go well if the first electrode and the conducive beam are close enough to keep the contact state between the conductive beam and the first electrode due to this electrostatic force.

This solves the problem caused by use of a metal-to-metal contact in the MEMS switch according to this embodiment. That is, a stable operation can be kept without providing a control electrode separately. It is therefore possible to provide a high-reliability MEMS switch without preventing electrodes from being more microscopic.

Here again, this structure is a structure in which ON capacitance is secured by a capacitance region (84) serving as a capacitance securing region forming a metal-to-metal contact between the first conductive layer and the conductive beam, and a contact state between the conductive beam and the three-layer structure beam is kept by the driven surface 86 serving as an electrostatic force securing region made of a dielectric-to-metal contact region or a dielectric-to-metal close region between the dielectric layer on the second conductive layer and the conductive beam.

Figure 15:
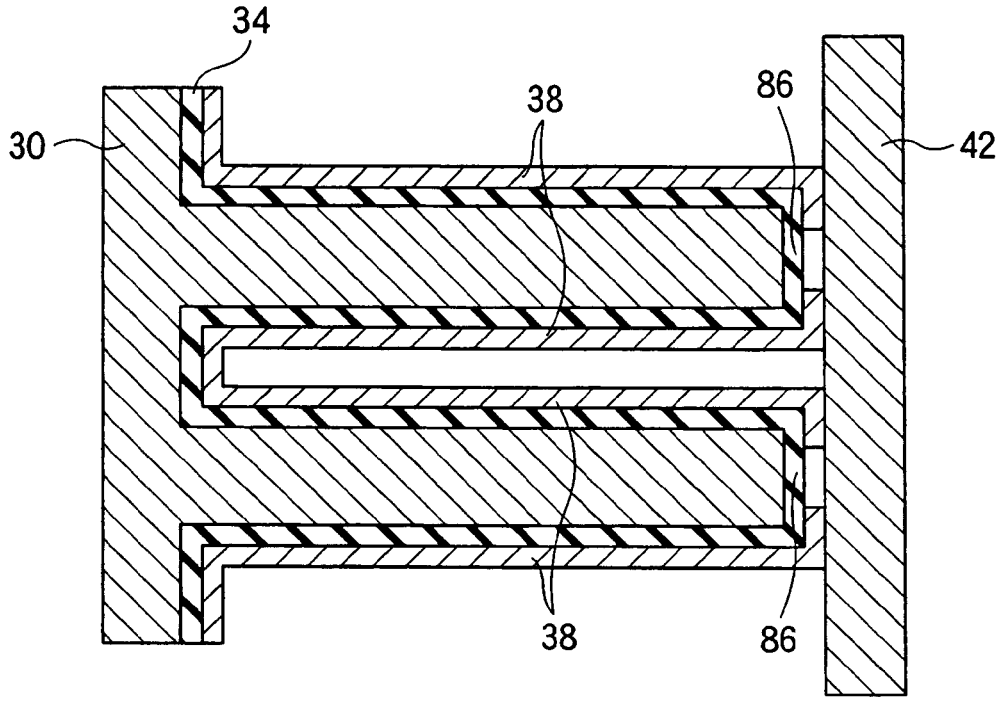
[FIG. 15] A modification diagram of the main portion enlarged section of the MEMS switch according to Embodiment 3 of the present invention.

FIG. 15 shows a modification of this embodiment, and shows a main portion enlarged view similar to FIG. 14. FIG. 15 shows the state where the MEMS switch has been turned ON so that the conductive beam 42 has abutted against the first electrode 38 made of the first three-layer structure beam. Here, there is another advantage than that of FIG. 14 in that the dielectric layer 34 on the second conductive layer 30 forming the driven surface 86 is located over the width of each protrusion portion.

With this configuration, the height of each protrusion portion can be increased to further increase the capacitance in the ON state. At the same time, the driven surface 86 is provided near the contact surface in the width of the protrusion portion so as to prevent the lowering of the electrostatic force to keep the contact state between the conductive beam and the first electrode.

Figure 16:
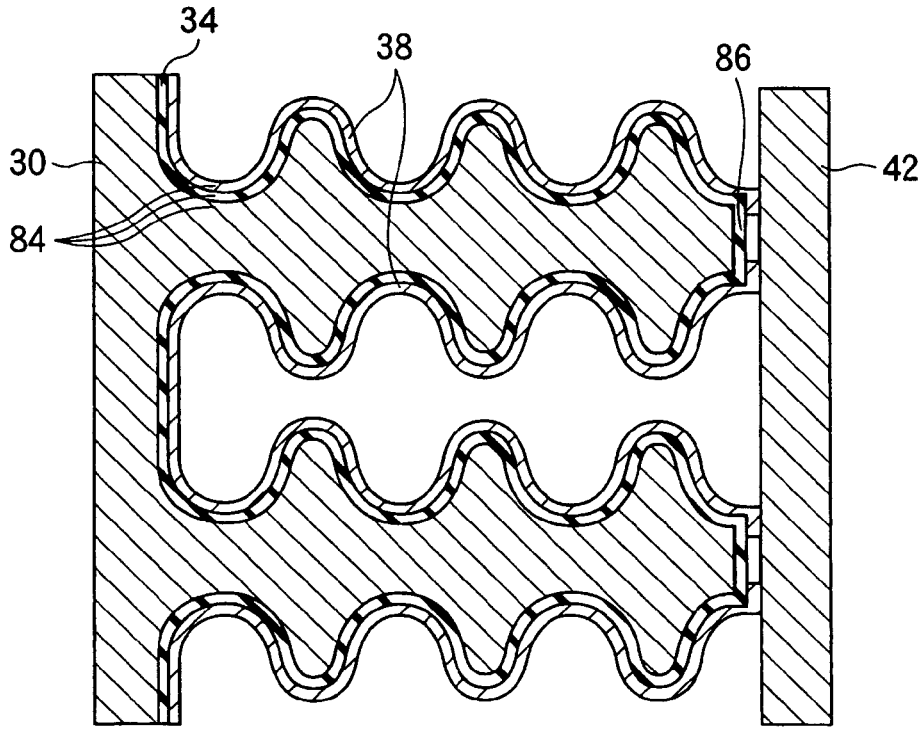
[FIG. 16] A modification diagram of the main portion enlarged section of the MEMS switch according to Embodiment 3 of the present invention.

FIG. 16 shows an MEMS switch according to a modification of this embodiment. FIG. 16 shows a main portion enlarged view similar to FIG. 15. Differently from FIG. 15, FIG. 16 is characterized in that the capacitance region 84 forming each protrusion portion having height is formed to be corrugated. Accordingly, there is an advantage that the higher ON capacitance can be secured as compared with the configuration shown in FIG. 15 where each protrusion portion is formed to be straight in its height direction. Although the capacitance region 84 is formed to be corrugated in FIG. 16, the capacitance region 84 may be an aggregate of triangles or the like.

In the MEMS switch according to this embodiment, the lowering of the capacitance formation area caused by the formation of this region for keeping the contact state between the conductive beam 42 and the three-layer structure beam (first electrode) 38 is compensated by the formation of capacitance in side walls, that is, vertical surfaces of the protrusion portions.

In such a manner, according to this embodiment, a high-performance MEMS switch large in ON/OFF capacitance change ratio can be obtained by increasing the capacitance when the MEMS switch is ON.

Although a straight beam is used as the conductive beam 42 in the Embodiment 3, the conductive beam 42 is not limited to the straight beam, but a comb-teeth configuration in which protrusion portions are formed in the beam may be used. Further, when the MEMS switch is formed by this method, the distance between the driven surface 86 and the conductive beam 42 is reduced so that the driving voltage can be reduced slightly.

INDUSTRIAL APPLICABILITY

As has been described above, according to the present invention, it is possible to provide an MEMS switch which is microscopic, low in driving voltage and high in switching speed. Accordingly, the MEMS switch can be applied to portable small-sized electronic equipment such as cellular phones, or the like.

The invention claimed is:

1. An MEMS switch comprising:

a substrate;

a conductive beam formed on a surface of the substrate; and a three-layer structure beam formed on the surface of the substrate and disposed to be opposed to the conductive beam, wherein the three-layer structure beam includes a first conductive layer, a second conductive layer and a dielectric layer sandwiched between the first conductive layer and the second conductive layer, wherein the first conductive layer is opposed to the conductive beam, wherein at least one of the conductive beam and the three-layer structure beam is displaced on a plane parallel to the substrate due to an electrostatic force so that the conductive beam and the first conductive layer can come into contact with each other, and wherein a conductive path is formed between the conductive beam and the second conductive layer when the conductive beam and the first conductive layer are in contact with each other.

2. The MEMS switch according to claim 1, wherein a surface of the second conductive layer on the dielectric layer side comprises irregularities.

3. The MEMS switch according to claim 1, wherein the first conductive layer and the second conductive layer are disposed to be parallel.

4. The MEMS switch according to claim 2, wherein at least one protrusion portion is provided in the surface on the dielectric layer side, and wherein the first conductive layer is provided in the at least one protrusion portion.

5. The MEMS switch according to claim 4, wherein the first conductive layer is provided only in the protrusion portion.

6. The MEMS switch according to claim 1, wherein the electrostatic force is applied between the second conductive layer and the conductive beam.

7. The MEMS switch according to claim 6, wherein the electrostatic force is applied even when the conductive beam and the first conductive layer are in contact with each other.

8. The MEMS switch according to claim 7, wherein the electrostatic force applied when the conductive beam and the first conductive layer are in contact with each other is at least as high enough of a force to keep the contact between the first conductive layer and the conductive beam.

9. The MEMS switch according to claim 7, wherein the electrostatic force applied when the conductive beam and the first conductive layer are in contact with each other is generated in a region of the conductive beam which is not in contact with the first conductive layer.

10. The MEMS switch according to claim 3, wherein the second conductive layer is formed to be larger than the first conductive layer, and the second conductive layer includes a region disposed opposite to the conductive beam without having the first conductive layer therebetween.

11. The MEMS switch according to claim 1, further comprising another three-layer structure beam, wherein the conductive beam is sandwiched between the two three-layer structure beams, wherein the second conductive layer of one of the three-layer structure beams forms an output terminal, while the second conductive layer of the other three-layer structure beam is connected to ground potential, and wherein at least one of the conductive beam and the two three-layer structure beams is displaced on a plane parallel to the substrate due to an electrostatic force so that the conductive beam and the first conductive layer of one of the three-layer structure beams can come into contact with each other, and a conductive path is formed between the conductive beam and the second conductive layer of said one of the three-layer structure beams when the conductive beam and the first conductive layer of said one of the three-layer structure beams are in contact with each other.

12. The MEMS switch according to claim 1, wherein the substrate is a silicon substrate.

13. The MEMS switch according to claim 1, wherein the substrate is a GaAs substrate.

14. The MEMS switch according to claim 1, wherein the substrate is a glass substrate.

15. The MEMS switch according to claim 1, wherein the surface of the substrate is coated with an insulating layer.

16. The MEMS switch according to claim 1, wherein the first and second conductive layers of the three-layer structure beam and the conductive beam include conductive layers formed in one and the same process.

17. The MEMS switch according to claim 1, wherein the conductive beam is formed as a fixed beam.

18. The MEMS switch according to claim 1, wherein the conductive beam is formed as a movable beam.

19. The MEMS switch according to claim 1, wherein the three-layer structure beam is formed as a movable beam.

20. The MEMS switch according to claim 1, wherein the three-layer structure beam is formed out of a vertical (metal-dielectric-metal)-layer lamination.

21. The MEMS switch according to claim 1, wherein a driven surface of the three-layer structure beam is formed across the three-layer structure beam in a longitudinal direction of the three-layer structure beam.

* * * * *